US007347928B2

(12) United States Patent
Van Beijnum et al.

(10) Patent No.: US 7,347,928 B2
(45) Date of Patent: Mar. 25, 2008

(54) PROCESS TO PREPARE A SPINDLE OIL, LIGHT MACHINE OIL AND A MEDIUM MACHINE OIL BASE OIL GRADE FROM THE BOTTOMS FRACTION OF A FUELS HYDROCRACKING PROCESS

(75) Inventors: Johannes Van Beijnum, Amsterdam (NL); Arjen Peter Geukema, Amsterdam (NL); Kevin John Anthony Polder, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 711 days.

(21) Appl. No.: 10/451,089

(22) PCT Filed: Dec. 18, 2001

(86) PCT No.: PCT/EP01/15134

§ 371 (c)(1),
(2), (4) Date: Jun. 18, 2003

(87) PCT Pub. No.: WO02/50213

PCT Pub. Date: Jun. 27, 2002

(65) Prior Publication Data

US 2004/0055931 A1 Mar. 25, 2004

(30) Foreign Application Priority Data

Dec. 19, 2000 (EP) ..... 00403588

(51) Int. Cl.
*C10G 65/12* (2006.01)
*C10G 73/42* (2006.01)

(52) U.S. Cl. ..... 208/18; 208/19; 208/27; 208/92; 208/97

(58) Field of Classification Search ..... 208/92, 208/97, 18, 19
See application file for complete search history.

(56) References Cited

U.S. PATENT DOCUMENTS 3,663,422 A 5/1972 Dun et al.

(Continued)

FOREIGN PATENT DOCUMENTS

CN 19941091152 8/1994

(Continued)

OTHER PUBLICATIONS

A. Hennico. et al. . "IFP's New Flexible Hydrocracking Process Combines Maximum Conversion with Production of High Viscosity. High VI Lube Stocks". Revue De L-Institut Francais Du Petroie. vol. 48. N 2. Mars-Avril 1993, pp. 127-139.

(Continued)

*Primary Examiner*—Ellen M. McAvoy

(57) ABSTRACT

A process to prepare a spindle oil, light machine oil and a medium machine oil base oil grade by:
(a) performing a separate catalytic dewaxing on a spindle oil fraction, a light machine oil fraction and a medium machine oil fraction as obtained in a vacuum distillation of a bottoms fraction of a fuels hydrocracking process;
(b) performing a separate hydrofinishing of the light and medium machine oil fractions obtained in step (a);
(c) separating the low boiling compounds from the spindle oil, light machine oil and medium machine oil fractions as obtained in step (a) and (b) and obtaining the spindle oil, light machine oil and medium machine oil base oil grade;
(d) wherein the vacuum distillation is performed by alternatingly performing the distillation in two modes wherein the first mode (d1) the bottoms fraction is separated into a gas oil fraction, a spindle oil fraction, a medium machine oil fraction and a first rest fraction boiling between said spindle oil and medium machine oil fraction and in the second mode (d2) the bottoms fraction is separated into a gas oil fraction, a spindle oil fraction, a light machine oil fraction and a second rest fraction boiling above the light machine oil fraction.

17 Claims, 1 Drawing Sheet

U.S. PATENT DOCUMENTS

Figure 1:
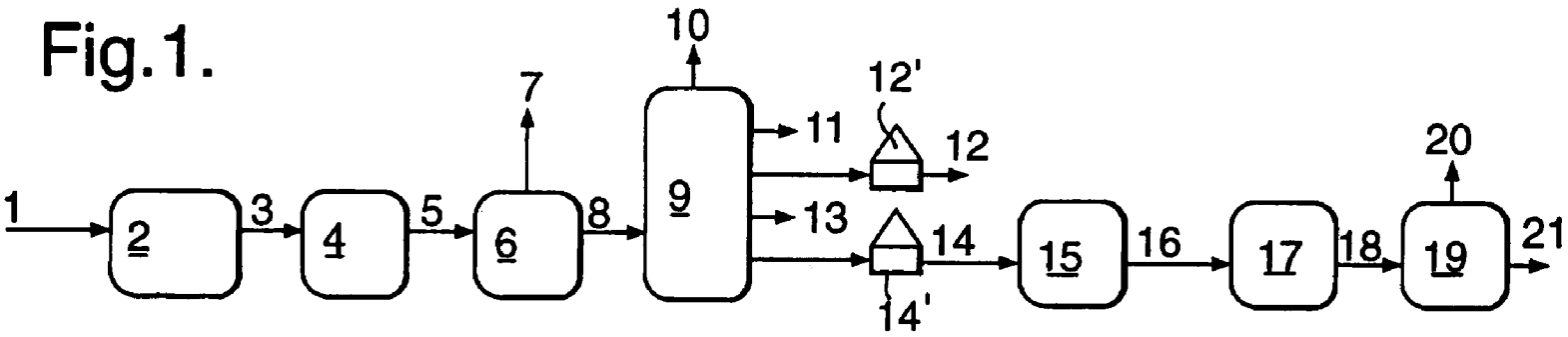

| | | | | | |
|---|---|---|---|---|---|
| 3,902,988 | A | * | 9/1975 | Bennett et al. | 208/80 |
| 4,181,598 | A | * | 1/1980 | Gillespie et al. | 208/58 |
| 4,574,043 | A | | 3/1986 | Chester et al. | |
| 4,695,365 | A | * | 9/1987 | Ackelson et al. | 208/89 |
| 4,851,109 | A | | 7/1989 | Chen et al. | |
| 4,859,311 | A | | 8/1989 | Miller | |
| 4,990,238 | A | * | 2/1991 | Cruzan et al. | 208/18 |
| 5,053,373 | A | | 10/1991 | Zones | |
| 5,157,191 | A | | 10/1992 | Bowes et al. | |
| 5,252,527 | A | | 10/1993 | Zones | |
| 5,306,416 | A | | 4/1994 | Le et al. | |
| 5,378,351 | A | * | 1/1995 | Guichard et al. | 208/143 |
| 5,580,442 | A | | 12/1996 | Kwon et al. | |
| 5,877,130 | A | * | 3/1999 | Kohara et al. | 508/174 |
| 6,099,719 | A | * | 8/2000 | Cody et al. | 208/87 |
| 6,264,826 | B1 | * | 7/2001 | Xiao et al. | 208/18 |
| 6,872,693 | B2 | * | 3/2005 | Cain | 508/185 |

FOREIGN PATENT DOCUMENTS

| | | |
|---|---|---|
| EP | 0649896 | 6/1996 |
| EP | 0712922 | 10/1996 |
| EP | 0699225 | 2/1999 |
| EP | 0832171 | 1/2000 |
| EP | 0705321 | 3/2000 |
| EP | 0 994 173 | 4/2000 |
| EP | 1352040 | 8/2005 |
| FR | 2182637 | 12/1973 |
| GB | 1390953 | 4/1975 |
| WO | WO198901506 | 2/1989 |
| WO | 94/10263 | 5/1994 |
| WO | WO199426848 | 11/1994 |
| WO | WO199500604 | 1/1995 |
| WO | 97/18278 | 5/1997 |
| WO | 00/29511 | 5/2000 |
| WO | WO200029512 | 5/2000 |

OTHER PUBLICATIONS

Zakatarian, J. A. et al., "All-Hydroprocessing Route for High VI-Lubes", Energy Process, vol. 7, 1987, pp. 59-64: Presentation at AIChe Spring National Meeting, New Orleans, Apr. 6-10, 1986.

Farell, T. R. and Zakarian, J. A., "Lube Facility Makes High-Quality Lube Oil From Low- Quality Feed" in Oil & Gas Journal, May 19, 1986.

Wilson, M. W. et al, Commercialization of Isodewaxing - A New Technology for Dewaxing to Manufacture High Quality Lube Base Stocks, presented at 1994 NPRA. National Fuels and Lubricants Meeting, Nov. 3-4, 1994, Houston, Texas, together with Affidavit of Mr. Wilson.

Howell, R. L. et al, "Hydroprocessing Routes to Improved Base Oil Quality and Refining Economics", paper presentation at Asia Fuels and Lubes Conference. Singapore, Jan. 2000, together with letter to Ms. Gaudiel dated Dec. 15, 1999.

Bridge, A. G. et al, "Isodewaxing - Improving Refining Economics" in Petroleum Technology Quarterly, Summer 1996, pp. 17-23.

Helton, T.E. et al, "Catalytic Hydroprocessing : A Good Alternative to Solvent Processing", in Oil & Gas Journal, Jul. 20, 1998, pp. 58-67.

* cited by examiner

PROCESS TO PREPARE A SPINDLE OIL, LIGHT MACHINE OIL AND A MEDIUM MACHINE OIL BASE OIL GRADE FROM THE BOTTOMS FRACTION OF A FUELS HYDROCRACKING PROCESS

The invention is directed to a process to prepare a spindle oil, light machine oil and a medium machine oil base oil grade from the bottoms fraction of a fuels hydrocracking process.

Such a process is known from EP-A-699225. This publication discloses a process to prepare two base oil grades, a so-called 100N and 150N grade. The heavier 150N grade typically has a viscosity at 100° C. of between 5.5 cSt and 6 cSt according to this publication. In this process the fuels hydrocracker bottom fraction, further also referred to as hydrowax, is fractionated in a vacuum distillation into various fractions comprising the two desired base oil fractions. The base oil fractions are subsequently further processed, by dewaxing and stabilisation, to the desired base oil grade and the remaining fractions are recycled to the fuels hydrocracker. The one through conversion of the fuels hydrocracker is described to be about 60% which results in a low fuel yield in the fuels hydrocracker.

WO-A-9718278 discloses a process, comparable to the process of above cited EP-A-699225, wherein up to 4 base oil grades, e.g. a 60N, 100N and 150N, are prepared starting from hydrowax. In this process hydrowax is fractionated in a vacuum distillation into 5 fractions of which the heavier 4 fractions are further processed to different base oil grades by first performing a catalytic dewaxing followed by a hydrofinishing step.

In an article of Hennico, A., Billon, A., Bigeard, P. H., Peries, J. P., "IFP's New Flexible Hydrocracking Process . . . ", Revue de l'institut Francais du Pétrole, Vol. 48, No. 2, Mars-Avril, a fuels hydrocracking process is described wherein several products are obtained ranging from fuels to three base oils qualities, namely of the 100N-, 200N- and 350N-type.

In view of the above processes there is room for improving the overall yield of base oil products as calculated on the hydrocracker bottoms.

The following process aims at improving this yield of base oil grades as calculated on the hydrocracker bottoms. Process to prepare a spindle oil, light machine oil and a medium machine oil base oil grade by (a) performing a separate catalytic dewaxing on a spindle oil fraction, a light machine oil fraction and a medium machine oil fraction as obtained in a vacuum distillation of a bottoms fraction of a fuels hydrocracking process;

(b) performing a separate hydrofinishing of the light and medium machine oil fractions obtained in step (a);

(c) separating the low boiling compounds from the spindle oil, light machine oil and medium machine oil fractions as obtained in step (a) and (b) and obtaining the spindle oil, light machine oil and medium machine oil base oil grade;

(d) wherein the vacuum distillation is performed by alternatingly performing the distillation in two modes wherein the first mode (d1) the bottoms fraction is separated into one or more gas oil fractions, a spindle oil fraction, a medium machine oil fraction and a first rest fraction boiling between said spindle oil and medium machine oil fraction and in the second mode (d2) the bottoms fraction is separated into one or more gas oil fractions, a spindle oil fraction, a light machine oil fraction and a second rest fraction boiling above the light machine oil fraction.

It has been found that by the above process more than two grades of high quality base oils can be prepared in a high yield on hydrowax. The required base oil properties for the different grades such as viscosity, flash point and/or Noack volatility are easily met by performing the distillation in the two dedicated modes according to the process of the present invention.

In the context of the present invention terms as spindle oil, light machine oil and medium machine oil will refer to base oil grades having an increasing kinematic viscosity at 100° C. and wherein the spindle oil additionally has a maximum volatility specification. The advantages of the present process are achieved for any group of base oils having such different viscosity requirement and volatility specification. Preferably a spindle oil is a light base oil product having a kinematic viscosity at 100° C. of below 5.5 cSt and preferably above 3.5. The spindle oil can have either a Noack volatility, as determined by the CEC L-40-T87 method, of preferably below 20% and more preferably below 18% or a flash point, as measured according to ASTM D93, of above 180° C. Preferably the light machine oil has a kinematic viscosity at 100° C. of below 9 cSt and preferably above 6.5 cSt and more preferably between 8 and 9 cSt. Preferably the medium machine oil has a kinematic viscosity at 100° C. of below 13 cSt and preferably above 10 cSt and more preferably between 11 and 12.5 cSt. The corresponding base oil grade can have a viscosity index of between 95 and 120.

Terms as spindle oil fraction, light machine oil fraction and medium machine oil fraction refer to the distillate fraction as obtained in the vacuum distillation and from which the corresponding base oil grades are prepared.

With a fuels hydrocracker in the context of the present invention is meant a hydrocracker process which main products are naphtha, kerosene and gas oil. The conversion, expressed in the weight percentage of the fraction in the feed which boils above 370° C. which are converted to products boiling below 370° C., in the hydrocracker process is typically above 50 wt %. This in contrast to a dedicated base oil hydrocracker which main products are base oil fractions and which process operates at a feed conversion of below 50 wt % and more typically between 20 and 40 wt %. Examples of possible fuels hydrocracker processes, which may yield a bottoms fraction which can be used in the present process, are described in the above referred to EP-A-699225, EP-A-649896, WO-A-9718278, EP-A-705321, EP-A-994173 and U.S. Pat. No. 4,851,109.

Preferably the fuels hydrocracker is operated in two steps, consisting of a preliminary hydrotreating step followed by a hydrocracking step. In the hydrotreating step nitrogen and sulphur are removed and aromatics are saturated to naphthenes. The hydrowax and the resulting base oil grades will thus as a consequence have a very low content of sulphur, typically below 100 ppmw, and a very low content of nitrogen, typically below 10 ppmw.

In order to improve the yield of medium machine oil grade on hydrowax the fuels hydrocracker is more preferably operated by first (i) hydrotreating a hydrocarbon feed at a feed conversion, wherein the conversion, as defined above, of less than 30 wt % and preferably between 15 and 25 wt %, and (ii) hydrocracking the product of step (i) in the presence of a hydrocracking catalyst at such a conversion level that the overall conversion of step (i) and (ii) is between 55 and 80 wt % and preferably between 60 and 75 wt %.

It has been found that by performing the combined hydrotreating and hydrocracking step as described above a hydrowax is obtained which yields a high quantity of medium machine oil grade and of acceptable quality with respect to viscosity index. In addition a sufficient quantity of naphtha, kerosine and gas oils are obtained by this process. Thus a fuels hydrocracker process is obtained wherein simultaneously products ranging from naphtha to gas oil and a hydrowax is obtained, which hydrowax has the potential to yield a medium machine oil base oil grade. The viscosity index of the resulting base oil grades is suitably between 95 and 120, which is acceptable to yield base oils having a viscosity index according to the API Group II specifications. It has been found that the wt % of medium machine oil fraction, which fraction has a kinematic viscosity at 100° C. of above 9, in the 370° C. plus fraction of the hydrowax can be more than 15 wt % and more especially more than 25 wt % if the hydrocracker is operated as described above.

It has been found that in the hydrotreating step (i) the viscosity index of the hydrowax and the resulting base oil grades increases with the conversion in said hydrotreating step. By operating the hydrotreating step at high conversion levels of more than 30 wt % viscosity index values for the resulting base oils of well above 120 can be achieved. A disadvantage of such a high conversion in step (i) is however that the yield of medium machine oil fraction will be undesirably low. By performing step (i) at the above described conversion levels an API Group II medium machine oil grade base oil can be obtained in a desired quantity. The minimum conversion in step (i) will be determined by the desired viscosity index, of between 95 and 120, of the resulting base oil grades and the maximum conversion in step (i) is determined by the minimum acceptable yield of medium machine oil grade.

The preliminary hydrotreating step is typically performed using catalyst and conditions as for example described in the above-mentioned publications related to hydrocracking. Suitable hydrotreating catalysts generally comprise a metal hydrogenation component, suitably Group IVB or VIII metal, for example cobalt-molybdenum, nickel-molybdenum, on a porous support, for example silica-alumina or alumina. The hydrotreating catalysts suitably contains no zeolite material or a very low content of less than 1 wt %. Examples of suitable hydrotreating catalysts are the commercial ICR 106, ICR 120 of Chevron Research and Technology Co.; 244, 411, DN-120, DN-180, DN-190 and DN-200 of Criterion Catalyst Co.; TK-555 and TK-565 of Haldor Topsoe A/S; HC-k, HC-P, HC-R and HC-T of UOP; KF-742, KF-752, KF-846, KF-848 STARS and KF-849 of AKZO Nobel/Nippon Ketjen; and HR-438/448 of Procatalyse SA.

The hydrocracking step is preferably a catalyst comprising an acidic large pore size zeolite within a porous support material with an added metal hydrogenation/dehydrogenation function. The metal having the hydrogenation/dehydrogenation function is preferably a Group VIII/Group VIB metal combination, for example nickel-molybdenum and nickel-tungsten. The support is preferably a porous support, for example silica-alumina and alumina. It has been found that a minimum amount of zeolite is advantageously present in the catalyst in order to obtain a high yield of medium machine oil fraction in the hydrowax when performing the hydrocracker at the preferred conversion levels as explained above. Preferably more than 1 wt % of zeolite is present in the catalyst. Examples of suitable zeolites are zeolite X, Y, ZSM-3, ZSM-18, ZSM-20 and zeolite beta of which zeolite Y is most preferred. Examples of suitable hydrocracking catalysts are the commercial ICR 220 and ICR 142 of Chevron Research and Technology Co; Z-763, Z-863, Z-753, Z-703, Z-803, Z-733, Z-723, Z-673, Z-603 and Z-623 of Zeolist International; TK-931 of Haldor Topsoe A/S; DHC-32, DHC-41, HC-24, HC-26, HC-34 and HC-43 of UOP; KC2600/1, KC2602, KC2610, KC2702 and KC2710 of AKZO Nobel/Nippon Ketjen; and HYC 642 and HYC 652 of Procatalyse SA.

The feed to the preliminary hydrotreater can be for example a vacuum gas oil, light cycle oil obtained in a fluid catalytic cracking process or a deasphalted oil or mixtures of such feeds. In order to be able to prepare the desired quantity of medium machine oil grade a relatively heavy feed to the hydrocracking step is desired. Preferably a feed is used wherein more than 10 wt %, preferably more than 20 wt % and most preferably more than 30 wt % of the compounds present in said feed boil above 470° C. Suitably less than 60 wt % of the compounds present in the feed boil above 470° C.

The effluent of the hydrocracker is separated into one or more of the above referred to fuels fractions and a hydrowax containing residue. The hydrowax containing residue, wherein the hydrowax boils predominately above 370° C., is used as feed of the vacuum distillation of step (d). With boiling predominately above 370° C. is especially meant that more than 95 wt % boils above 370° C. The cut point between hydrowax and fuels fraction is not critical for the base oil preparation, because any lower boiling compounds present in the hydrowax containing residue will be removed from the base oil fractions in the vacuum distillation step (d).

The vacuum distillation step (d) can be operated as any conventional vacuum distillation which is suited to separate a hydrocarbon feed boiling mainly above 350° C. under atmospheric conditions into different fractions. Typical pressures in the bottom of the vacuum distillation are between 80 and 110 mmhg. The cutting temperatures to obtain the different fractions will depend on the mode of distillation and the viscosity specification of the desired fractions for that distillation mode. By measuring the viscosity's of the obtained fractions and preferably also the Noack volatility for the spindle oil fraction one skilled in the art can easily determine the optimal vacuum distillation conditions. The rest fractions obtained in the vacuum distillation can optionally be recycled to the hydrocracker. Preferably this rest fraction is blended into the feed of a fluid catalytic cracker or steam cracker.

The catalytic dewaxing step and the hydrofinishing step and any further processing steps are preferably performed in a so-called blocked out operation, wherein, in a preferably continuous process, one base oil grade is prepared at a time. In this manner use can be made of the same apparatuses for the different base oils grades. In such a blocked out process the fractions obtained in the vacuum distillation are stored in for example storage tanks before being sequentially further processed in steps (a)–(c).

The catalytic dewaxing step can be performed by any process wherein in the presence of a catalyst and hydrogen the pour point of the base oil fraction is reduced. Suitably the pour point is reduced by at least 10° C. and more suitably by at least 20° C. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of a base oil fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material which is essentially free of alumina is used. Examples of these binder materials are as silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191. Examples of suitable dewaxing catalysts as described above a silica bound and dealuminated Pt/ZSM-5 and silica bound and dealuminated Pt/ZSM-23, silica bound and dealuminated Pt/ZSM-12 and silica bound and dealuminated Pt/ZSM-22, as for example described in WO-A-200029511 and EP-B-832171.

Catalytic dewaxing conditions are known in the art and typically involve operating temperatures in the range of from 200 to 500° C., suitably from 250 to 400° C., hydrogen pressures in the range of from 10 to 200 bar, weight hourly space velocities (WHSV) in the range of from 0.1 to 10 kg of oil per litre of catalyst per hour (kg/1/hr), suitably from 0.2 to 5 kg/1/hr, more suitably from 0.5 to 3 kg/1/hr and hydrogen to oil ratios in the range of from 100 to 2,000 litres of hydrogen per litre of oil. If the dewaxing step and the hydrofinishing step are performed in cascade the pressure level in both steps in suitably of the same order. Because higher pressures are preferred in the hydrofinishing step in order to obtain a base oil having the desired properties the dewaxing step is suitably also performed at these higher pressures, even though a more selective dewaxing could have been achieved at lower pressures. If no hydrofinishing step is required, as has been found to be the case when preparing the spindle oil base oil grade, a lower catalytic dewaxing pressure can be advantageously be applied. Suitable pressures are from 15 to 100 bar and more suitably from 15 to 65 bar.

The hydrofinishing step is to improve the quality of the dewaxed fraction. In this step lube range olefins are saturated, heteroatoms and colour bodies are removed and if the pressure is high enough residual aromatics are saturated. Preferably the conditions are so chosen to obtain a base oil grade comprising more than 95 wt % saturates and more preferably such that a base oil is obtained comprising more than 98 wt % saturates. The hydrofinishing step is suitably carried out in cascade with the dewaxing step.

The hydrofinishing step is suitable carried out at a temperature between 230 and 380° C., a total pressure of between 10 to 250 bar and preferably above 100 bar and more preferably between 120 and 250 bar. The WHSV (Weight hourly space velocity) ranges from 0.3 to 2 kg of oil per litre of catalyst per hour (kg/1.h).

The hydrofinishing or hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten.

Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Suitable hydrogenation catalysts include those catalysts comprising as one or more of nickel (Ni) and cobalt (Co) in an amount of from 1 to 25 percent by weight (wt %), preferably 2 to 15 wt %, calculated as element relative to total weight of catalyst and as the Group VIB metal component one or more of in an amount of from 5 to 30 wt %, preferably 10 to 25 wt %, calculated as element relative to total weight of catalyst. Examples of suitable nickel-molybdenum containing catalyst are KF-847 and KF-8010 (AKZO Nobel) M-8-24 and M-8-25 (BASF), and C-424, DN-190, HDS-3 and HDS-4 (Criterion). Examples of suitable nickel-tungsten containing catalysts are NI-4342 and NI-4352 (Engelhard), C-454 (Criterion). Examples of suitable cobalt-molybdenum containing catalysts are KF-330 (AKZO-Nobel), HDS-22 (Criterion) and HPC-601 (Engelhard).

For hydrocracked feeds containing low amount of sulphur, as in the present invention, preferably platinum containing and more preferably platinum and palladium containing catalysts are used. The total amount of these noble Group VIII metal component(s) present on the catalyst is suitably from 0.1 to 10 wt %, preferably 0.2 to 5 wt %, which weight percentage indicates the amount of metal (calculated as element) relative to total weight of catalyst.

Preferred supports for these palladium and/or platinum containing catalysts are amorphous silica-alumina, whereby more preferably the silica-alumina comprises from 2 to 75 wt % of alumina. Examples of suitable silica-alumina carriers are disclosed in WO-A-9410263. A preferred catalyst comprises an alloy of palladium and platinum preferably supported on an amorphous silica-alumina carrier of which the commercially available catalyst C-624 of Criterion Catalyst Company (Houston, Tex.) is an example.

After the topping step an optional further step is performed to improve the base oil stability by contacting the effluent of the hydrofinishing step with active carbon as for example described in EP-A-712922.

After the hydrofinishing step a low boiling fraction is preferably removed by means of distillation in order to obtain a product having the desired volatility properties.

The invention is also directed to a novel medium machine oil grade having a kinematic viscosity at 100° C. of between 11 and 12.5 cSt, a viscosity index of between 95 and 120, a sulphur content of below 100 ppmw and a saturates content of above 98 wt % obtainable by a process as described above. This base oil grade can be used in a lubricant composition comprising also one or more additives. The lubricant composition is suitably used as a 20W50 automotive lubricant or as a ISO 100 industrial formulation, for example as a hydraulic or turbine oil. dr The process is illustrated in FIG. 1.

FIG. 1 shows that a hydrocarbon mixture (1) is fed to a preliminary hydrotreater (2). The effluent (3) of hydrotreater (2) is fed to a hydrocracker step (4). The hydrotreater (2) and hydrocracker (4) may be combined in one vessel in a so-called stacked bed. The effluent or hydrocrackate (5) of the hydrocracker (4) is separated in distillation step (6) in one or more fuels fractions (7) and a bottoms or hydrowax fraction (8). The hydrowax (8) is further separated in vacuum distillation unit (9) into a heavy gas oil fraction (10), a vacuum gas oil fraction (11) and, as illustrated for distillation mode (d1), a spindle oil fraction (12), a medium machine oil fraction (14) and a first rest fraction (13) boiling between said spindle oil and medium machine oil fraction. The vacuum gas oil fraction can optionally also be further processed to a light grade base oil by performing steps (a)–(c) of the process according to the present invention. In a blocked out mode the spindle oil fraction (12) (not shown) and the medium machine oil fraction (14) (as shown) are further processed, from storage tanks (12') and (14'), in catalytic dewaxing unit (15) yielding a dewaxed fraction (16), which fraction (16) is further processed in hydrofinishing unit (17). From the mixture (18) obtained in hydrofinishing unit (17) a low boiling fraction (20) is removed in distillation unit (19) thereby yielding the desired base oil grade (21). The total fuels make of this process comprises mixtures (7), (10), (11) and (20).

Figure 2:
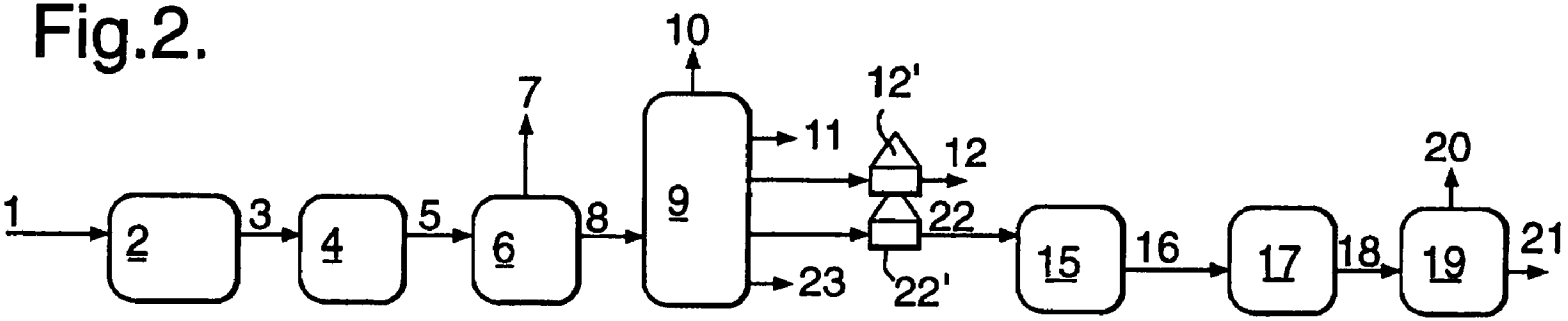

FIG. 2 shows distillation mode (d2). In this mode the hydrowax (8) is further separated in vacuum distillation unit (9) into a heavy gas oil fraction (10), a vacuum gas oil fraction (11), a spindle oil fraction (12), a light machine oil fraction (22) and a second rest fraction (23) boiling above the light machine oil fraction. In a blocked out mode the spindle oil fraction (12) (not shown) and the light machine oil fraction (22) (as shown) are further processed, from storage tanks (12') and (22') to the respective base oil grade. All other references have the meaning as in FIG. 1.

The invention will be illustrated by the following non-limiting examples. Examples 1–2 represent calculated results, wherein use has been made of hydrocracker models, plant data and experimental results. It is believed that these result give a good representation of how the process according to the invention will perform in reality.

EXAMPLE 1

Using a Single Mode Vacuum Distillation

To a distillation column a hydrowax containing residue is fed at a rate of 4883 ton feed per day (t/d). The feed has the properties as listed in Table 1.

TABLE 1

| Feed | |
|---|---|
| boiling point at vol 5% (° C.) | 287 |
| vK at 100° C. (cSt) | 3.95 |
| wax content (wt %) | 18.2 |
| sulphur (ppm) | 24 |
| nitrogen (ppm | <1 |

The feed is separated in a vacuum distillation into 1042 t/d heavy gas oil, 1285 t/d vacuum gas oil, 591 t/d of a rest fraction boiling between the spindle oil fraction and the vacuum gas oil, 291 t/d of light machine oil, 664 t/d of medium machine oil and 300 t/d of a residue fraction. The spindle oil, light machine oil and medium machine oil fractions were subsequently further processes by means of catalytic dewaxing and hydrofinishing in a blocked out mode. From the product ex hydrofinishing the lower boiling fraction is removed which totals on average for all base oil grades to 422 t/d. The process yields (on an average 350 day runtime basis) 557 t/d spindle oil grade, 214 t/d light machine oil and 471 t/d medium machine oil grade. The yield of base oils (Spindle oil, light machine oil and medium machine oil) on hydrowax containing residue is about 25 wt %.

The quality of the base oil grades is as listed in Table 2.

TABLE 2

| | Spindle oil grade | light machine oil grade | medium machine oil grade |
|---|---|---|---|
| Viscosity at 100° C. (cSt) (1) | 4.65 | 8.65 | 12.0 |
| Viscosity Index (2) | 106 | 103 | 100 |
| Noack volatility (%) (3) | 16.5 | — | — |
| Pour Point (° C.) (4) | −15 | −12 | −12 |
| saturates (wt %) (5) | 99.2 | 98.4 | 98.1 |

(1) according to ASTM D445;
(2) according to ASTM D2270;
(3) according to CEC L-40-T-87;
(4) according to ASTM D97;
(5) according to ASTM D207

EXAMPLE 2

Using Two Modes of Distillation According the Present Invention

Example 1 is repeated with the same feed except that during 245 days of the total of 350 days on stream a hydrowax feed of 4109 t/d is separated in the vacuum distillation into 866 t/d heavy gas oil, 1153 t/d vacuum gas oil, 723 t/d of spindle oil, 416 t/d of a first rest fraction boiling between the spindle oil fraction and the medium machine oil fraction and 951 t/d of medium machine oil. The thus obtained spindle oil and medium machine oil fractions were subsequently further processes by means of catalytic dewaxing and hydrofinishing in a blocked out mode. From the product ex hydrofinishing the lower boiling fraction is removed. This distillation mode yields (on an average yearly basis) 557 t/d spindle oil grade and 660 t/d medium machine oil grade.

During the remaining days on stream the hydrowax is separated in the vacuum distillation into 866 t/d heavy gas oil, 1153 t/d vacuum gas oil, 723 t/d of spindle oil, 1083 t/d of light machine oil fraction and 329 t/d in a second rest fraction boiling above the light machine oil fraction. The thus obtained spindle oil and light machine oil fractions were subsequently further processes by means of catalytic dewaxing and hydrofinishing in a blocked out mode. From the product ex hydrofinishing the lower boiling fraction is removed. This distillation mode yields (on an average 350 day runtime basis) 557 t/d spindle oil grade and 751 t/d light machine oil grade.

Both distillation modes thus yield (on an average yearly basis) 557 t/d spindle oil grade, 214 t/d light machine oil and 471 t/d medium machine oil grade. The yield of base oils (Spindle oil, light machine oil and medium machine oil) on hydrowax containing residue is about 30 wt %. The quality of the base oil grades is as in Table 2.

EXAMPLE 3

A hydrowax containing residue having the properties as listed in Table 1 was distilled and a light machine oil fraction was obtained having a kinematic viscosity at 100° C. of 7.24 cSt, an initial boiling point (5 vol % TBP) of 440° C. and a final boiling (95 vol % TBP) point of 550° C. This light machine oil fraction was subsequently dewaxed by contacting the fraction with the same dealuminated-platinum loaded-ZSM-5/silica catalyst as used in Examples 11 and 12 of WO-A-0029511 in the presence of hydrogen at a temperature of 354° C., an outlet pressure of 141 bar, a WHSV of 1.00 kg/1.hr and a hydrogen gas rate of 640 Nl/kg feed.

The effluent thus obtained was subsequently hydrofinished by contacting the effluent in the presence of freshly supplied hydrogen over a commercial PtPd on amorphous silica-alumina carrier (C-624 of Criterion Catalyst Company (Houston, Tex.). The operating conditions were a hydrogen partial pressure of 129 bar, a WHSV of 1.0 kg/l/h, a recycle gas rate of 500 Nl/kg and a temperature of 260° C.

Gaseous components were separated from the effluent of the hydrofinishing by vacuum flashing at a cutting temperature of 445° C. A light fraction was subsequently separated by distillation after which the desired API Group II light machine oil grade was obtained having the properties as listed in Table 3.

TABLE 3

| | API Group II light machine oil |
|---|---|
| saturates (wt %) (IP 391) | 98.6 |
| polars (wt %) (IP 391) | 1.4 |
| sulphur (mg/kg) | 18 |
| nitrogen (mg/kg) | <1 |
| Viscosity Index | 107 |
| viscosity at 100° C. (cSt) | 8.513 |
| viscosity at 40° C. (cSt) | 62.54 |
| pour point (° C.) | −12 |

We claim:

1. A Process to prepare a spindle oil, light machine oil and a medium machine oil base oil grade by (a) performing a separate catalytic dewaxing on a spindle oil fraction, a light machine oil fraction and a medium machine oil fraction as obtained in a vacuum distillation of a bottoms fraction of a fuels hydrocracking process;

(b) performing a separate hydrofinishing of the light and medium machine oil fractions obtained in step (a);

(c) separating the low boiling compounds from the spindle oil, light machine oil and medium machine oil fractions as obtained in step (a) and (b) and obtaining the spindle oil, light machine oil and medium machine oil base oil grade;

(d) wherein the vacuum distillation is performed by alternatingly performing the distillation in two modes wherein the first mode (d1) the bottoms fraction is separated into a gas oil fraction, a spindle oil fraction, a medium machine oil fraction and a first rest fraction boiling between said spindle oil and medium machine oil fraction and in the second mode (d2) the bottoms fraction is separated into a gas oil fraction, a spindle oil fraction, a light machine oil fraction and a second rest fraction boiling above the light machine oil fraction.

2. The process of claim 1, wherein the spindle oil fraction has a kinematic viscosity at 100° C. of between 3.5 and 5.5 cSt and a Noack volatility of below 20% or a flash point of above 180° C., the light machine oil fraction has a kinematic viscosity at 100° C. of between 6.5 and 9 cSt and the medium machine oil grade has a kinematic viscosity at 100° C. of between 10 and 13.5 cSt.

3. The process of claim 2, wherein the medium machine oil grade has a kinematic viscosity at 100° C. of between 11 and 12.5 cSt.

4. The process of claim 3, wherein the catalytic dewaxing in step (a) is performed by contacting the vacuum distillation fraction with hydrogen and a catalyst containing a molecular sieve such that the pour point is reduced by at least 10° C.

5. The process of claim 4, wherein the molecular sieve is ZSM-5, ZSM-12, ZSM-22, ZSM-23, SSZ-32, ZSM-35, ZSM-48 or SAPO-11.

6. The process of claim 5, wherein the molecular sieve is an intermediate pore size zeolite and wherein the catalyst also comprises a binder and a Group VIII metal.

7. The process of claim 6, wherein the binder is a low acidity refractory oxide binder material which is essentially free of alumina and wherein the surface of the intermediate pore size zeolite has been modified by subjecting the zeolite to a surface dealumination treatment.

8. The process of claim 7, wherein the bottoms fraction of a fuels hydrocracking process is obtained by operating a fuels hydrocracker which hydrocracker yields a naphtha, kerosine, gas oil and a bottoms fraction, wherein the bottoms fraction contains more than 15 wt % of a fraction, which has a kinematic viscosity at 100° C. of above 9 cSt, and wherein the weight percentage is calculated on the total of compounds which boil above 370° C. in the bottoms fraction, by first (i) hydrotreating a hydrocarbon feed at a feed conversion of less than 30 wt % and (ii) hydrocracking the product of step (i) in the presence of a hydrocracking catalyst at such a conversion level that the overall conversion of step (i) and (ii) is between 55 and 80 wt %.

9. The process of claim 8, wherein the feed conversion in hydrotreating step (i) is between 15 and 25 wt %.

10. The process of claim 9, wherein the overall conversion is between 60 and 75 wt %.

11. The process of claim 10, wherein the catalyst used in step (ii) comprises more than 1 wt % of an acidic large pore size zeolite, a porous support and a Group VIII/Group VIB metal combination.

12. A process for preparing at least one grade of a base oil product, wherein said process comprises:

passing a hydrowax feed to a vacuum distillation unit;

operating said vacuum distillation unit in a first distillation mode (d1) so as to separate said hydrowax feed to yield a first gas oil fraction, a first spindle oil fraction, a medium machine oil fraction and a first rest fraction boiling between said first spindle oil fraction and said medium machine oil fraction;

discontinuing operating of said vacuum distillation unit in said first distillation mode (d1) and, thereafter, operating said vacuum distillation unit in a second distillation mode (d2) so as to separate said hydrowax feed to yield a second gas oil fraction, a second spindle oil fraction, a light machine oil fraction and a second rest fraction boiling above said light machine oil fraction; and passing a dewaxing unit feed, comprising a vacuum distillate selected from the group consisting of said first spindle oil fraction, said second spindle oil fraction, said light machine oil fraction, said medium machine oil fraction and mixtures of two or more thereof, to a catalytic dewaxing unit for reducing the pour point of said dewaxing unit feed and to yield a dewaxed product followed by passing said dewaxed product to a hydrofinishing unit for improving the quality of said dewaxed product and to thereby provide said base oil product.

13. A process as recited in claim 12, wherein said passing step includes:

separately, passing said first spindle oil fraction or said second spindle oil fraction or a spindle oil fraction mixture of said first spindle oil fraction and said second spindle oil fraction as said dewaxing unit feed to said catalytic dewaxing unit to yield a dewaxed spindle oil product followed by passing said dewaxed spindle oil product to said hydrofinishing unit to thereby provide a spindle oil base oil product.

14. A process as recited in claim 13, wherein said passing step further includes:

separately, passing said light machine oil fraction as said dewaxing unit feed to said catalytic dewaxing unit to yield a dewaxed light machine oil product followed by passing said dewaxed light machine oil product to said hydrofinishing unit to thereby provide a light machine oil base oil product.

15. A process as recited in claim 14, wherein said passing step further includes:

separately, passing said medium machine oil fraction as said dewaxing unit feed to said catalytic dewaxing unit to yield a dewaxed medium machine oil product followed by passing said dewaxed medium machine oil product to said hydrofinishing unit to thereby provide a medium machine oil base oil product.

16. A process as recited in claim 15, wherein said first spindle oil fraction and said second spindle oil fraction both have a kinematic viscosity at 100° C. of between 3.5 and 5.5 cSt and a Noack volatility of below 20% or a flash point of above 180° C., wherein said light machine oil fraction has a kinematic viscosity at 100° C. of between 6.5 and 9 cSt, and wherein said medium machine oil fraction has a kinematic viscosity at 100 00 of between 11 and 13.5 cSt.

17. A process as recited in claim 16, wherein said catalytic dewaxing unit provides for the contacting of said dewaxing unit feed in the presence of hydrogen with a dewaxing catalyst comprising a molecular sieve under catalytic dewaxing conditions suitable for reducing the pour point of said dewaxing unit feed by at least 10° C.

* * * * *